US008167058B2

(12) United States Patent
Blangé

(10) Patent No.: US 8,167,058 B2
(45) Date of Patent: May 1, 2012

(54) METHOD AND ASSEMBLY FOR ABRASIVE JET DRILLING

(75) Inventor: Jan-Jette Blangé, Rijswijk (NL)

(73) Assignee: Shell Oil Company, Houston, TX (US)

( * ) Notice: Subject to any disclaimer, the term of this patent is extended or adjusted under 35 U.S.C. 154(b) by 336 days.

(21) Appl. No.: 12/594,241

(22) PCT Filed: Apr. 2, 2008

(86) PCT No.: PCT/EP2008/053937

§ 371 (c)(1),
(2), (4) Date: Oct. 1, 2009

(87) PCT Pub. No.: WO2008/119821

PCT Pub. Date: Oct. 9, 2008

(65) Prior Publication Data

US 2010/0078217 A1 Apr. 1, 2010

(30) Foreign Application Priority Data

Apr. 3, 2007 (EP) ..... 07105521

(51) Int. Cl.
*E21B 7/18* (2006.01)

(52) U.S. Cl. ..... 175/54; 166/66.5

(58) Field of Classification Search ..... 166/66.5; 175/54

See application file for complete search history.

(56) References Cited

U.S. PATENT DOCUMENTS

| | | | | |
|---|---|---|---|---|
| 4,936,386 | A | 6/1990 | Colangelo | 166/292 |
| 6,581,682 | B1 | 6/2003 | Parent et al. | 166/180 |
| 6,695,080 | B2 * | 2/2004 | Presley et al. | 175/391 |
| 2007/0044962 | A1 | 3/2007 | Tibbles | 166/278 |

FOREIGN PATENT DOCUMENTS

| | | |
|---|---|---|
| WO | WO0066872 | 11/2000 |
| WO | WO0208562 | 1/2002 |
| WO | WO0234653 | 5/2002 |
| WO | WO2005005765 | 1/2005 |
| WO | WO 2005005767 A1 * | 1/2005 |
| WO | WO2005088064 | 9/2005 |
| WO | WO2006065144 | 6/2006 |
| WO | WO2007057426 | 5/2007 |

* cited by examiner

*Primary Examiner* — William P Neuder

(57) ABSTRACT

A method for supplying a jet of abrasive fluid for the purpose of providing a borehole by removing earth formation material through abrasion comprises a drill string and a drilling assembly connected to the drill string. The drilling assembly comprises a jetting device with a mixing space, a drilling fluid, a particle inlet, an abrasive fluid outlet for discharging a mixture of drilling fluid and magnetic particles, and a magnetic particle circulation system comprising a supporting surface which is exposed to a return stream along the drilling assembly. The method includes fixing a magnetic device with respect to the supporting surface, selecting a magnetic field density that which increases along the sloping supporting surface, attracting magnetic particles onto the supporting surface, and making the magnetic particles move over the sloping supporting surface (under the influence of the magnetic field of the magnetic device.

22 Claims, 4 Drawing Sheets

METHOD AND ASSEMBLY FOR ABRASIVE JET DRILLING

PRIORITY CLAIM

The present application claims priority of PCT Application EP2008/053937, filed 2 Apr. 2008, which claims priority to European Patent Application No. 071.05521.4 filed 3 Apr. 2007.

The invention is related to a method for operating an earth formation drilling device arranged to supply a jet of abrasive fluid for the purpose of providing a borehole by removing earth formation material through abrasion, comprising a drill string and a drilling assembly connected to the drill string, said drilling assembly comprising a jetting device comprising a mixing space, a drilling fluid inlet for feeding a drilling fluid into the mixing space, a particle inlet for feeding magnetic particles into the mixing space, an abrasive fluid outlet for discharging a mixture of drilling fluid and magnetic particles from the mixing space and onto the earth formation material, and a magnetic particle circulation system comprising a supporting surface which is exposed to a return stream along the drilling assembly after abrading the earth formation material, a magnetic device for attracting the magnetic particles onto the supporting surface and for feeding said particles to the particle inlet, said supporting surface sloping radially inwardly and having at least one entrance connected to the particle inlet.

Such a drilling method is disclosed in WO-A-2005/005765. According to said method, a drilling assembly is applied having a magnetic device which is rotatable about a longitudinal axis. The abrasive magnetic particles experience a magnetic field which is displaced together with the rotation of the magnet. As a result of the displacement of the magnetic field the particles are driven to the entrance of the supporting surface. With the aim of bringing the magnetic device into rotation, a drive motor and a transmission system are accommodated in the drill string. This has however several disadvantages.

The drive motor and transmission are rather vulnerable to the aggressive conditions which prevail at greater depths. This means that measures should be taken to protect these components well, which leads to rather bulky dimensions. Moreover, the supply of energy to the drive motor may lead to complications, such as damages to electric lines etc. causing malfunctioning.

The object of the invention is therefore to provide a method for operating a drilling assembly of the type described before which is more reliable and more easy to perform. Said object is achieved by the steps of:

- fixing the magnetic device with respect to the supporting surface,
- selecting a magnetic field density which increases along the sloping supporting surface towards the entrance,
- attracting magnetic particles onto the supporting surface under the influence of the fixed magnetic device,
- making the magnetic particles move over the sloping supporting surface under the influence of the magnetic field of the magnetic device.

In contrast to the prior art method employing drilling assemblies equipped with magnetic devices for extracting magnetic abrasive particles from the drilling fluid, it appears that a desired flow of magnetic particles from the supporting surface to the magnetic particle entrance can be obtained without a moving action of the magnetic device. This is made possible by selecting a specific pattern of the magnetic field density along the supporting surface, as well as by selecting a specific slope for the supporting surface. Due to the fact that said magnetic field density increases towards the entrance, in combination with the sloping shape of the supporting surface, the magnetic particles are driven towards and into the entrance.

In other words, the magnetic particles are circulated while the magnetic device is in a fixed state and a fixed position with respect to the supporting surface. At the same time a magnetic field density is established which increases along the sloping surface towards the entrance.

In particular, the method according to the invention may comprise the steps of:

- exerting a magnetic force Fm on the magnetic particles,
- selecting a sloping surface having a normal line which includes a non-zero angle with respect to the magnetic force vector.

In case the supporting surface has a low coefficient of friction, the friction force, which is oriented along the supporting surface, is small in comparison to the normal force. The magnetic force vector has a component oriented along the supporting surface which should be large enough to overcome said friction force, whereby it is ensured that the magnetic particles are transported towards the entrance. This effect can be promoted by the step of selecting a magnetic field density which reaches a maximum value at or near the location of the entrance. Furthermore, the movement of the magnetic particles towards the entrance can de promoted by the drag force which is exerted by the drilling fluid flow.

The amount of magnetic particles which is recirculated in this manner can be varied in several ways. This can be achieved by influencing the magnetic field density at the supporting surface by displacing the magnetic device with respect to the supporting surface to another fixed position. According to a first possibility, the recirculation of the magnetic particles can be varied by displacing the magnetic device according to the rotation axis and/or perpendicular thereto to another fixed position. According to a second possibility, this may entail the step of rotating the magnetic device in circumferential direction of the drill string to another fixed position.

The invention is furthermore related to a drilling assembly for connection to, and rotation with, a drill string in an earth formation drilling device arranged to supply a jet of abrasive fluid for the purpose of providing a borehole by removing earth formation material through abrasion, comprising a distance holder which is to face the earth formation material, a jetting device comprising a mixing space, a drilling fluid inlet for feeding a drilling fluid into the mixing space, a magnetic particle inlet for feeding magnetic particles into the mixing space, an abrasive fluid outlet for discharging a mixture of drilling fluid and magnetic particles from the mixing space and onto the earth formation material, and a magnetic particle circulation system comprising a supporting surface which is exposed to the abrasive fluid return stream which flows along the drilling assembly after abrading the earth formation material, a magnetic device for attracting the magnetic particles onto the supporting surface and for feeding said particles to the particle inlet, said supporting surface having at least one entrance connected to the second inlet and radially inwardly sloping towards said entrance.

According to the invention, the magnetic device has at least one fixed position with respect to the supporting surface, in which fixed position the magnetic field density increases along the sloping supporting surface.

This can in particular be achieved in case the magnetic device has at least one fixed position in which the magnetic field density is maximal at or near each entrance.

The circumstance that the magnetic device may be kept stationary has the advantage that in general a drive motor and transmission can be omitted. This increases the reliability and of the drilling assembly, and moreover provides a more compact lay-out.

The desired magnetic field density pattern can be obtained in different ways. For instance, the magnetic field density at the supporting surface can be regulated by selecting a certain distance or eccentricity between the magnetic device and said surface. Furthermore, it is possible to apply non magnetic members between the magnetic device and the supporting surface.

Although in service the magnetic device has a fixed position with respect to the supporting surface, in some cases the magnetic device may be set in several fixed positions. Thereby, the amount of magnetic abrasive particles which is circulated can be controlled, and thus the erosiveness of the jet of drilling fluid. This can for instance be achieved in an embodiment wherein an actuator is provided by means of which the magnetic device is displaceably in a direction generally parallel to the rotation axis. In this connection, furthermore an actuator may be provided by means of which the magnetic device is also be rotatable in circumferential direction. Such actuators only need to be able to provide a setting of the magnet, but not a constant drive as is the case in the prior art drilling assembly.

In a preferred embodiment, two entrances are provided which are at a distance from each other, seen in the circumferential direction, each of said entrances being connected to the second inlet and the supporting surface sloping to each of said entrances, the poles of the magnetic device each being positioned near a respective one of said entrances.

In this embodiment, a diametric magnetic device can be used, each pole of such device being positioned near one of said entrances. The magnetic device may comprise a single magnet, or a stack of magnets. Furthermore, a radially outwardly extending ridge may be provided between the entrances, said supporting surface having two supporting surface parts on opposite sides of the ridge and said supporting surface parts each radially inwardly sloping towards a respective entrance. The poles of a diametric field magnet may positioned each near one of those supporting surface parts. Preferably, a drilling fluid conduit is provided within the ridge, said conduit being connected to the drilling fluid inlet of the jetting device.

As mentioned before, the magnetic particles travel over the supporting surface. In order to promote this movement, the supporting surface may have a relatively low coefficient of friction. For instance, the supporting surface may have a polished surface, or the supporting surface may have a friction reducing coating, e.g. a Ni—Cr-carbide coating.

The drilling assembly may be provided with a distance holder which is to face the earth formation material.

The invention will now be explained further with reference to an embodiment of the drilling assembly as shown in the drawings.

Figure 1:
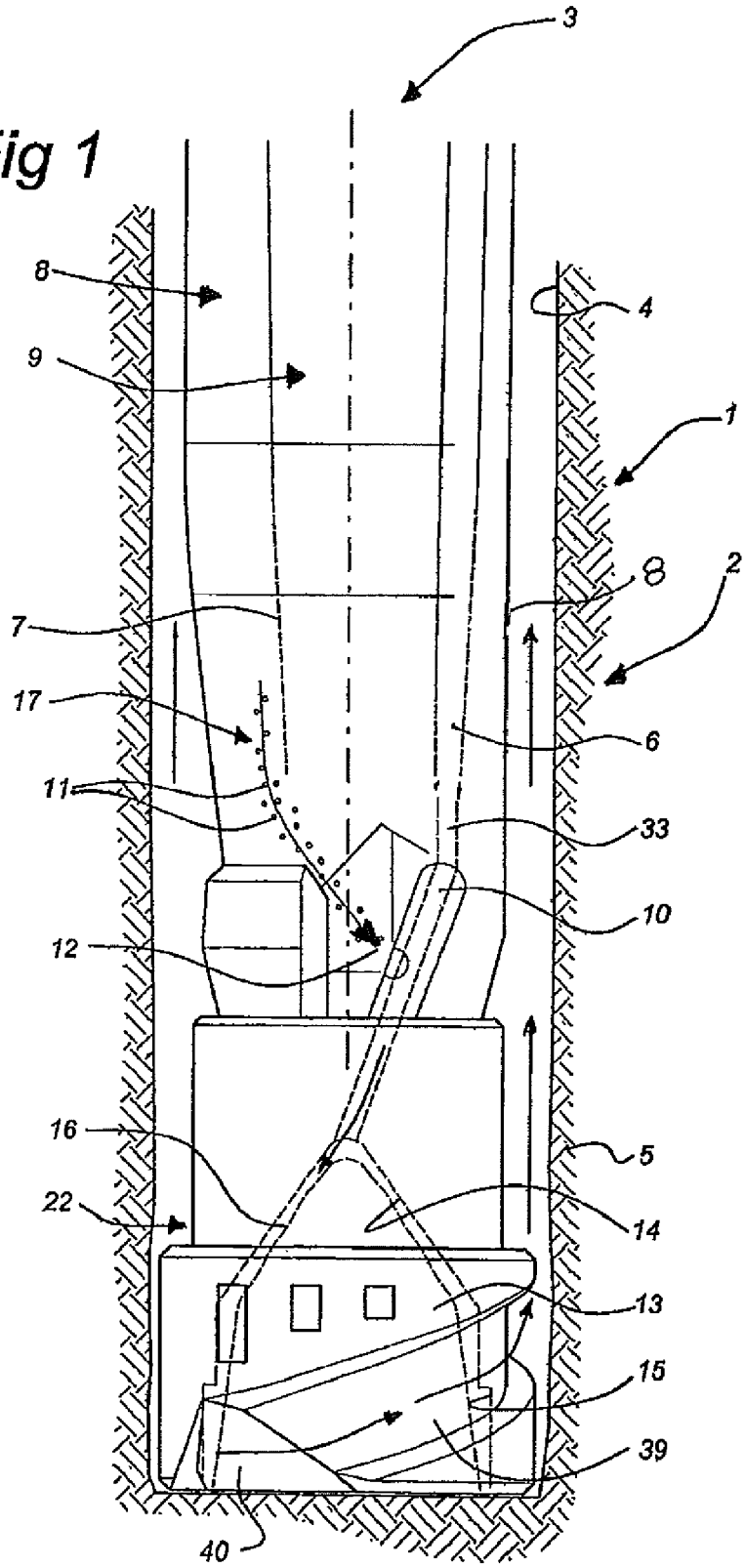
FIG. 1 shows a side view of the lowermost part of the drilling assembly according to the invention.
Figure 2:
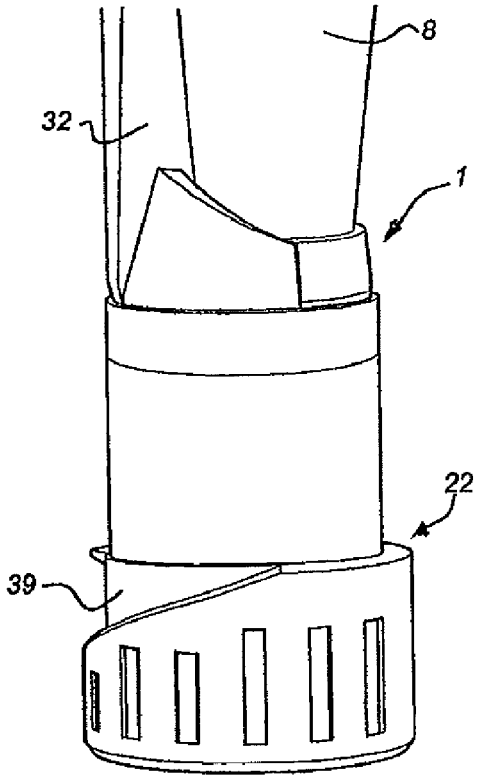
FIG. 2 shows an opposite side view.

The earth drilling device 2 as shown in FIGS. 1 and 2 is accommodated in a borehole 4 in an earth formation 5 and comprises a drilling assembly 1 and a drill string 3. The drill string 3 is suspended from a drilling rig at the surface of the earth formation 5, and comprises a pressure conduit 6 by means of which a mixture of a drilling fluid and magnetic particles is supplied to the jet nozzle 10 which is visible in the partially broken away view of FIG. 1.

The jet nozzle 10 comprises a mixing chamber 38, which is fed with magnetic particles from the particle inlet 12, and with pressurized drilling fluid from the inlet 33. The jet nozzle 10 discharges the drilling fluid mixed with steel abrasive particles into the chamber 13. The chamber 13 is accommodated in the distance holder 22 and has a trumpet shaped upper part 14 and an essentially cylindrical skirt 15. The fluid/particle mixture generates a cone shaped downhole bottom 16. Subsequently, the fluid-particle mixture leaves the chamber 13 through the opening 40 at the lower end of the distance holder 22, and continues its path through the helical groove 39 and upwardly along the drilling assembly 2.

The drilling device furthermore comprises a magnetic separator 9 which consists of a magnet 7 contained in a magnet housing 8.

Figure 3:
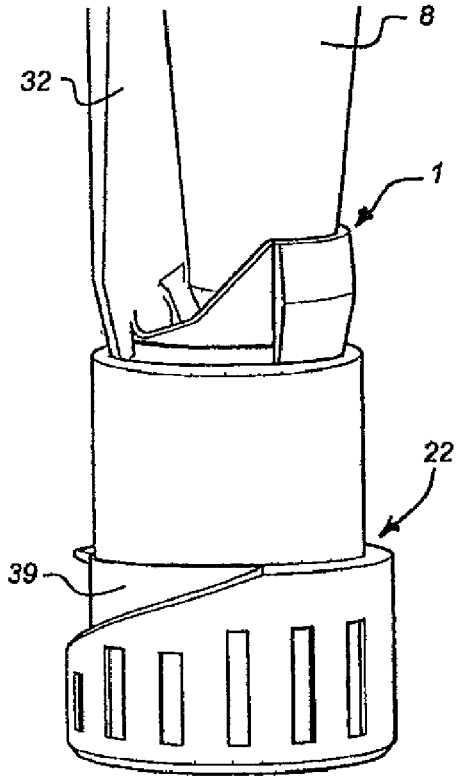
FIG. 3 shows the side view according to FIG. 2, with a cap removed.

Steel abrasive particles 11 are extracted from the drilling fluid at the level of the magnetic separator 9. Under the influence of the magnetic field of the magnet 7 of the magnetic separator 9, the steel abrasive particles 11 are attracted onto the surface 17 of the magnet housing 8. As will be clear from FIGS. 2, 3 and 5, the surface 17 of the magnet housing 8 comprises two supporting surface parts 30, 31, each provided with an entrance 34. Said supporting surface parts 30, 31 are separated by a ridge 32, which contains the feed channel 33 for supplying drilling fluid to the jet nozzle 10.

Figure 4:
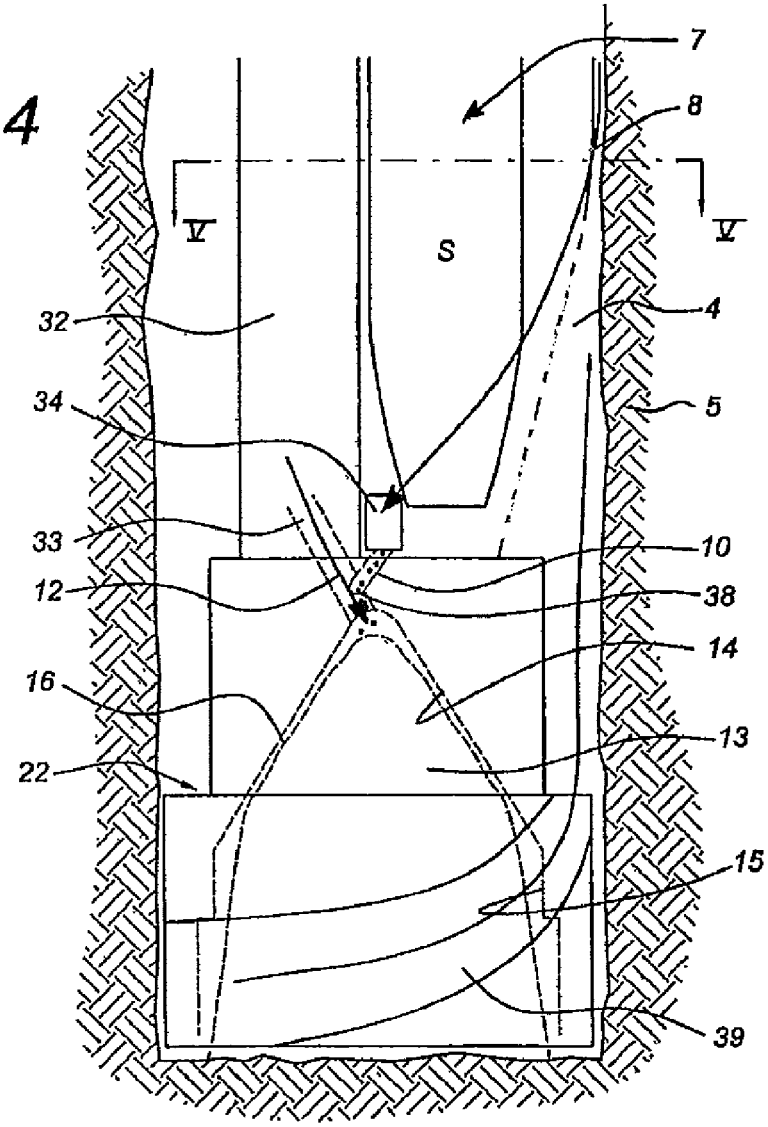
FIG. 4 shows a schematic side view with flow patterns.
Figure 5:
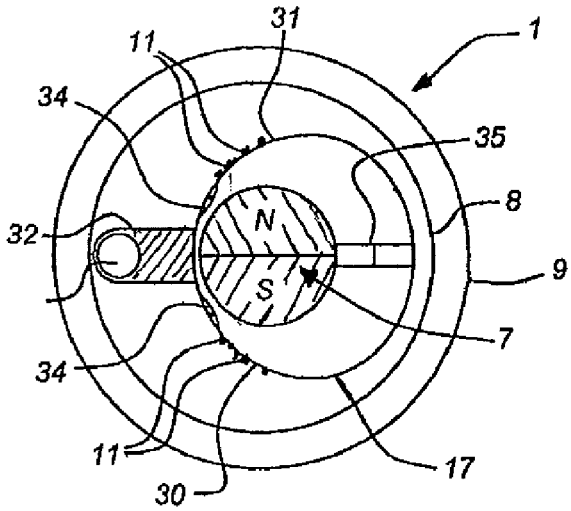
FIG. 5 shows a cross section according to V-V of FIG. 4.

As a result of the shape of the magnet housing 8, which tapers towards the particle inlet 12 of the jet nozzle 10, and the particular magnetic field as generated by the magnet 7, the steel abrasive particles 11 on the magnet housing 8 are drawn towards the entrances 34 in the supporting surface parts 30, 31: see FIGS. 4 and 5. Subsequently said steel abrasive particles are sucked into the particle inlet 12 of the jet nozzle 10 by the under pressure which is generated in the throat of the jet nozzle by the high velocity fluid.

As further shown in FIGS. 4 and 5, the magnetic device 7 has a north pole N and a south pole S, which are each close to respectively the supporting surface parts 31, 30. The magnetic device 7 has a specific distance towards these supporting surface parts 31, 30, which distance can be adjusted by means of an actuator 35. This distance determines to a large extent the rate at which the magnetic particles 11 are attracted onto said supporting surface parts 31, 30.

Figure 6:
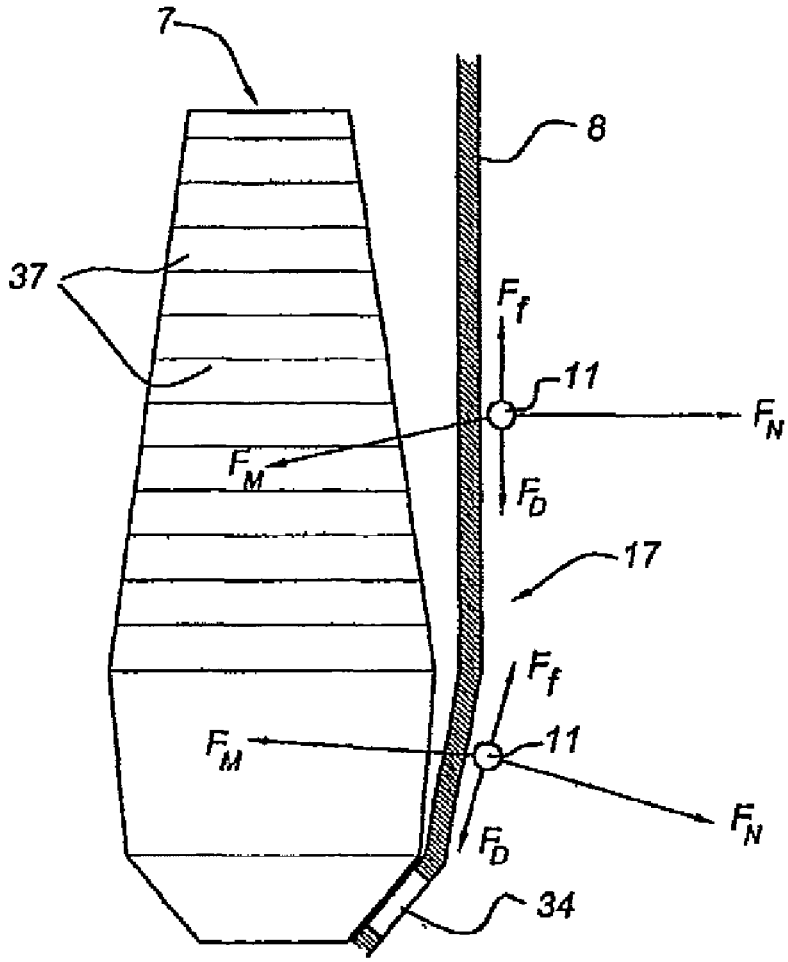
FIG. 6 shows schematically the force components acting on a magnetic particle.

The schematic representation in FIG. 6 shows the forces exerted on the magnetic particle 11, attracted onto the supporting surface 17 of the magnet housing 8. The magnetic device 7, which in the embodiment shown consists of a stack of magnets 37, exerts a magnetic force Fm on the magnetic particle 11. Furthermore, the friction force Ff, the normal force Fn and the drag force Fd act on the particle 11. The resultant force Ftot is the sum of these forces.

At the upper part, the cross sectional dimensions of the magnet 7 become smaller, which results in a force Ftot which is usually directed downwardly. The drag force Fd is different at different locations, and depends on the flow of drilling fluid on the outside the magnet housing 18. In most locations, that force is generally directed towards the inlet 34. The magnetic force increases in a downward direction over the supporting surface, as a result of the increasing cross sectional shape of the magnet and the closer vicinity thereof to the magnet housing wall in said downward direction. As a result of the increasing force exerted on the particle while travelling downward over the supporting surface, the particles are accelerated on said surface towards the inlet 34 which promotes a speedy and unobstructed recovery of said particles. In particular, the sum of the drag force Fd and the decomposed of the magnetic force Fm along the supporting surface 17 should be larger than the friction force Ff.

What is claimed is:

1. Method for operating an earth formation drilling device arranged to supply a jet of abrasive fluid for the purpose of providing a borehole by removing earth formation material through abrasion, comprising a drill string and a drilling assembly connected to the drill string, said drilling assembly comprising a jetting device comprising a mixing space, a drilling fluid inlet for feeding a drilling fluid into the mixing space, a particle inlet for feeding magnetic particles into the mixing space, an abrasive fluid outlet for discharging a mixture of drilling fluid and magnetic particles from the mixing space and onto the earth formation material, and a magnetic particle circulation system comprising a supporting surface which is exposed to a return stream along the drilling assembly after abrading the earth formation material, a magnetic device for attracting the magnetic particles onto the supporting surface and for feeding said particles to the particle inlet, said supporting surface sloping radially inwardly and having at least one entrance connected to the particle inlet, comprising the steps of:

fixing the magnetic device with respect to the supporting surface, selecting a magnetic field density that increases along the sloping supporting surface towards the entrance, attracting magnetic particles onto the supporting surface under the influence of the fixed magnetic device, making the magnetic particles move over the sloping supporting surface under the influence of the magnetic field of the magnetic device.

2. The method according to claim 1, comprising the steps of:

exerting a magnetic force Fm on the magnetic particles, selecting a sloping surface having at least one normal line which includes a non-zero angle with respect to the magnetic force vector.

3. The method according to claim 2, comprising the steps of:

exerting a drag force Fd on the particles by the drilling fluid, making the sum of the drag force Fd and the decomposed of the magnetic force Fm become larger than the friction force Ff exerted by the supporting surface on the particle.

4. The method according to claim 1, comprising the step of:

selecting a magnetic field density that reaches a maximum value at the location of the entrance.

5. The method according to claim 1, comprising the step of:

influencing the magnetic field density at the supporting surface by displacing the magnetic device with respect to the supporting surface.

6. The method according to claim 5, comprising the step of:

displacing the magnetic device according to at least one of the rotation axis and perpendicular thereto to another fixed position.

7. The method according to claim 5, comprising the step of:

rotating the magnetic device in circumferential direction of the drill string to another fixed position.

8. A drilling assembly for connection to, and rotation with, a drill string in an earth formation drilling device arranged to supply a jet of abrasive fluid for the purpose of providing a borehole by removing earth formation material through abrasion, comprising a jetting device comprising a mixing space, a drilling fluid inlet for feeding a drilling fluid into the mixing space, a particle inlet (12) for feeding magnetic particles into the mixing space, an abrasive fluid outlet for discharging a mixture of drilling fluid and magnetic particles from the mixing space and onto the earth formation material, and a magnetic particle circulation system comprising a supporting surface which is exposed to a return stream along the drilling assembly after abrading the earth formation material, a magnetic device for attracting the magnetic particles onto the supporting surface and for feeding said particles to the particle inlet, said supporting surface having at least one entrance connected to the particle inlet and radially inwardly sloping towards said entrance, wherein the magnetic device is fixed with respect to the supporting surface, in which fixed position the magnetic field density increases along the sloping supporting surface.

9. The drilling assembly according to claim 8, wherein the magnetic device has at least one fixed position in which the magnetic field density is maximal at or near each entrance.

10. The drilling assembly according to claim 8, wherein the magnetic device is movable in a direction that is at least one of generally parallel and perpendicular to the rotation axis to another fixed position.

11. The drilling assembly according to claim 8, wherein the magnetic device is rotatable in circumferential direction.

12. The drilling assembly according to claim 8, wherein at least one actuator is provided for setting the magnetic device.

13. The drilling assembly according to claim 8, wherein two entrances are provided which are at a distance from each other, seen in the circumferential direction, each of said entrances being connected to the particle inlet and the supporting surface sloping to each of said entrances, the poles of the magnetic device each being positioned near a respective one of said entrances.

14. The drilling assembly according to claim 13, wherein a radially outwardly extending ridge is provided between the entrances, said supporting surface having two supporting surface parts on opposite sides of the ridge and said supporting surface parts each radially inwardly sloping towards a respective entrance.

15. The drilling assembly according to claim 8, wherein the magnetic device has a diametric magnetization.

16. The drilling assembly according to claim 8, wherein the magnetic device comprises a stack of magnets.

17. The drilling assembly according to claim 8, wherein the magnetic device comprises a single magnet.

18. The drilling assembly according to claim 8, wherein the supporting surface has a relatively low coefficient of friction.

19. The drilling assembly according to claim 18, wherein the supporting surface has a polished surface.

20. The drilling assembly according to claim 18, wherein the supporting surface has a low friction coating comprising self-fluxing Ni—Cr alloy.

21. The drilling assembly according to claim 8, wherein a distance holder is provided which faces the earth formation.

22. A drilling assembly for connection to, and rotation with, a drill string in an earth formation drilling device arranged to supply a jet of abrasive fluid for the purpose of providing a borehole by removing earth formation material through abrasion, comprising a jetting device comprising a mixing space, a drilling fluid inlet for feeding a drilling fluid into the mixing space, a particle inlet (12) for feeding magnetic particles into the mixing space, an abrasive fluid outlet for discharging a mixture of drilling fluid and magnetic particles from the mixing space and onto the earth formation material, and a magnetic particle circulation system comprising a supporting surface which is exposed to a return stream along the drilling assembly after abrading the earth formation material, a magnetic device for attracting the magnetic particles onto the supporting surface and for feeding said particles to the particle inlet, said supporting surface having at least one entrance connected to the particle inlet and radially inwardly sloping towards said entrance, wherein the magnetic device has at least one fixed position with respect to the supporting surface, in which fixed position the magnetic field density increases along the sloping supporting surface;

wherein two entrances are provided which are at a distance from each other, seen in the circumferential direction, each of said entrances being connected to the article inlet and the supporting surface sloping to each of said entrances, the poles of the magnetic device each being positioned near a respective one of said entrances;

wherein a radially outwardly extending ridge is provided between the entrances, said supporting surface having two supporting surface parts on opposite sides of the ridge and said supporting surface parts each radially inwardly sloping towards a respective entrance; and wherein a drilling fluid conduit is provided within the ridge, said conduit being connected to the drilling fluid inlet of the jetting device.

* * * * *